US008132441B2

(12) United States Patent
Schlatter

(10) Patent No.: US 8,132,441 B2
(45) Date of Patent: Mar. 13, 2012

(54) METHOD AND DEVICE FOR FINE BLANKING AND FORMING A WORKPIECE

(75) Inventor: Ulrich Schlatter, Lyss (CH)

(73) Assignee: Feintool Intellectual Property AG, Lyss (CH)

( * ) Notice: Subject to any disclaimer, the term of this patent is extended or adjusted under 35 U.S.C. 154(b) by 601 days.

(21) Appl. No.: 12/283,676

(22) Filed: Sep. 15, 2008

(65) Prior Publication Data

US 2009/0090157 A1 Apr. 9, 2009

(30) Foreign Application Priority Data

Sep. 14, 2007 (EP) ..... 07018046

(51) Int. Cl.
*B21J 11/00* (2006.01)
*B21D 28/00* (2006.01)

(52) U.S. Cl. ..... 72/405.03; 72/332

(58) Field of Classification Search ..... 72/332–337, 72/341, 404, 405.01, 405.03, 405.06, 470, 72/472, 326; 29/37 R, 38 R, 35.5; 83/40, 83/55, 552

See application file for complete search history.

(56) References Cited

U.S. PATENT DOCUMENTS 1,892,168 A * 12/1932 Siegel ..... 72/336
3,831,426 A * 8/1974 Hakner ..... 72/405.03
3,848,452 A * 11/1974 Gargrave ..... 72/448
4,615,207 A * 10/1986 Oboshi et al. ..... 72/404

FOREIGN PATENT DOCUMENTS

DE 2 165 224 7/1973
DE 44 09 658 9/1995

* cited by examiner

*Primary Examiner* — Teresa Ekiert
(74) *Attorney, Agent, or Firm* — Jordan and Hamburg LLP

(57) ABSTRACT

A device and a method for fine blanking and forming a workpiece out of a flat strip includes. a cutting plate formed as a disc-shaped transfer part, with several cutting openings adapted to the effective elements which take up and clamp a cut out a blank to transport the blank from one machining stage to the next. The transfer part is turnable with regard to the effective elements of the upper part around a virtual axis parallel to the machining direction in the center of the transfer part, turnable perpendicular to it after a lift over the effective elements of the lower part, and the cutting openings in the transfer part are arranged on a common base circle, the radius of which coincides with the distance of the machining stage to the axis, and that the machining stages of the upper part are arranged on the base circle at fixed distances to each other, wherein the machining stages in the transfer part are allocated at least two machining elements diametrically opposed at the circumference, fixed in the pressure pad of the upper part, arranged parallel to the axis locking bolts and several arranged diametrically opposed at the circumference locking openings in the transfer part for adjusting, fixing and lining up the effective elements to each other.

18 Claims, 5 Drawing Sheets

METHOD AND DEVICE FOR FINE BLANKING AND FORMING A WORKPIECE

BACKGROUND OF THE INVENTION

The invention relates to a device for fine blanking and forming a workpiece from a flat strip with several machining steps, comprising effective elements, including for example, punches and/or a forming element pressure pad for the shearing and/or forming element, V-shaped projections arranged at the pressure pad and a pressure plate of an upper part, and a cutting die, ejector, coining anvil and pressure plate of a lower part in one machining cycle, consisting of blanking, stamping, preforming and/or punching or the like, wherein the flat strip is clamped between the closed upper and lower parts and movable in a feeding direction (Z) in the open state of upper and lower parts.

The invention further relates to a method for fine blanking and forming a workpiece from a flat strip, wherein the flat strip is submitted to several successive machining steps comprising effective elements including, for example, a shearing punch and/or forming element, a pressure pad, V-shaped projections arranged at the pressure pad and a pressure plate of an upper part, and a cutting die, ejector, coining stamp and pressure plate of a lower part of a machining cycle, consisting of blanking, stamping, preforming and/or punching or the like, wherein the flat strip is clamped between the closed upper and lower parts to be machined and is sequentially moved forward in the open state of upper and lower parts.

Fine blanked parts with formed functional areas are mostly produced in progressive tools comprising several sequential steps. In this process, a cut out blank is taken up by a cross slide and led to the next machining stage when the tool is open.

A device is known from DE 21 65 224 A1 for continuous blanking a multitude of identical workpieces out of a metal sheet, strip or the like, in a multiple die press, which are interlocked into each other for the optimum utilization of the material, wherein a blanking stand is arranged to house a shearing punch and a correspondingly formed die-plate, which together form a cutting or blanking tool. A shearing punch and die-plate are connected to each other via mechanical elements which, after every cutting operation, advantageously, when the press ram crosses the upper dead center, independently cause a synchronous horizontal 180° turn of the shearing punch and die-plate. This is realized by executing half of the turning movement during the ascending and descending strokes of the press rams, respectively. The target of this turning movement is to achieve a material saving interlocking of the blanks.

Further known from DE 44 09 658 A1, is a tool combination for blanking machines, especially for different machining of window and door casement sections or the like, wherein each tool has a die-plate and a punching element driven by the punching machine and the respective application of the tools is restrictedly guided by the punching machine. The die-plates of the tools are connected to a complex construction unit and rotatably supported on an axis which coincides with the direction of the movement of the punching machine drive. The respective punching elements also form a construction unit. An effectice guidance is provided between the construction units that secures respectively uniform turning positions and allows for approach and retreat of the construction units.

Despite all of the measures according to the state of the art, material consuming excessive dimensions at designing the metal blank development have to be provided, especially in the case of smaller parts produced according to a multiple cut concept, to avoid an influence of the forming operations on the geometry of the pressed screen. Consequently, in case of small parts per stroke, waste costs emerge which are higher than the costs of the parts, because fine blanking of certain sections of parts consumes quantities of material which are too large.

A further disadvantage is that due to transporting the blanked parts by means of a cross slide, the tool has to be opened, so that the cross slide can transport the blanked part to the next machining stage. Due to this, the specific production time per part is increased. Furthermore, the rams of the press have to nearly go to their ascending or descending dead centers, which limits the quantity of strokes. Often left or not taken out by the cross slide, slugs in the tool area lead to additional stoppages of the production process and to damages at workpieces.

At this state of the art, it is an object of the invention to provide a method and a device for fine blanking of small to medium sized parts which make it possible to significantly save valuable materials, to combine the machining function of the active elements with the transportation function from one machining stage to the following machining stage increasing at the same time the quantity of strokes and the efficiency and to avoid stoppages of the production process caused by not removed from the tool waste.

SUMMARY OF THE INVENTION

This object is realized by a device of the above mentioned kind which includes an upper part, including punches and/or a coining element serving as active elements, an upper pressure plate and a pressure pad for the punches and/or the coining element, said pressure pad including V-shaped projections carried thereon. The devive further includes a lower part, including a cutting die, an ejector, a coining anvil and a lower pressure plate. The flat strip is clamped between said upper and lower parts when closed, and is movable in a feeding direction in an open state of said upper and lower parts in one machining cycle including blanking, stamping, preforming and/or punching. The cutting die is formed as disc-shaped transfer part with several cutting openings adapted to the active elements, which take up and clamp a cut out blank, to transport the cut out blank from one machining stage to a next machining stage, the transfer part being turnable with regard to the active elements of the upper part around a virtual axis in a center of the transfer part and parallel to a machining direction, turnable perpendicular to it after a lift over the effective elements of the lower part. The cutting openings in the transfer part are arranged on a common base circle, a radius of which coincides with a distance of the machining stage to the virtual axis. The machining stages of the upper part are arranged on the common base circle at fixed distances to each other, and the machining stages in the transfer part are allocated at least two locking bolts diametrically opposed at the circumference, fixed in the pressure pad of the upper part, the locking bolts being arranged parallel to the virtual axis. Several of the locking bolts are arranged diametrically opposed at the circumference locking openings in the transfer part for adjusting, fixing and lining up the effective elements to each other.

In accordance with the invention, the cutting die takes over the effective function, i.e., serves as an active element of the cutting and/or forming process, as well as providing the transfer function for transporting the parts from machining stage to machining stage. That is why the cutting plate is formed as a disc-shaped transfer part with several adapted to the effective elements process openings, which take up and clamp the blanked workpiece or slug to transport it from one machining stage to the next, wherein the transfer part is turnable with regard to the effective elements of the upper part around a virtual axis parallel to the machining direction in the center of the transfer part, turnable perpendicular to it after a lift over the effective elements of the lower part, and the process openings in the transfer part are arranged on a common base circle coinciding with the distance of the machining stage to the axis, and that the machining elements of the upper part are arranged on the base circle at fixed distances to each other, wherein the machining stages in the transfer part are allocated at least two of the machining elements diametrically opposed at the circumference, fixed in the pressure pad of the upper part, arranged perpendicular to the axis locking bolts and several arranged diametrically opposed at the circumference locking bolt openings for adjusting, fixing and lining up the effective elements to each other.

The transfer part for executing of the lifting and turning movements, on the one hand has a guiding element fixed in a mounting arranged on the pressure pad for vertically moving the transfer part in the direction towards the locking bolt axis against the pressure pad and, on the other hand a turnable supported pivot in the thrust piece for turning the transfer part.

The lifting movement of the transfer part is advantageously carried out hydraulically via the thrust piece by the studs pressing the guiding element in the direction of the locking bolt axis.

The turning movement of the transfer part starts when the lifting movement is finished and the effective elements of the lower part no longer disturb the turning movement of the cutting die.

So that the locking bolts can engage the locking openings during locking upper part and lower part, i.e., arresting and positioning the transfer part, the axis of locking bolt and locking opening lie on a common line.

The device according to this invention makes it possible, besides carrying out one single machining cycle, to alternatively also carry out the machining stages of several machining cycles on base circles concentrically arranged with respect to the virtual rotation axis of the transfer part. This leads to a significant increase in the quantity of fabricated workpieces.

The feeding and outlet direction of the flat strip exceeds through the virtual rotation axis of the transfer part, i.e., through the center of the base circle. Every machining cycle is allocated at least one outlet channel which, depending on the quantity of machining stages, leads to the outside.

The slugs are removed to the outside via at least one outlet channel. The removal preferably is realized by means of blowing out in outside direction or band transport.

Removing the slugs separately has the advantage that the outlet of the finished workpieces is totally separated from waste removal. Thus the danger of a production stoppage due to slugs which are not removed is largely excluded.

The method according to this invention allows that the workpiece and/or the blank cut out of the flat strip is received and clamped in a process opening lying on a circuit, and that it is stored in the process opening. By a lift movement with following rotation movement by an amount which coincides with the distance of the effective elements to each other, the workpiece stored in the respective process opening stepwise reaches the next following machining stage, wherein during every turning step, the effective elements of the upper part and the effective elements of the lower part are brought to coincidence, and after having been adjusted and closed, complete each other to a pair of effective elements of the respective machining stage.

The method according to this invention has the great advantage that several machining cycles can be carried out at the same time, wherein a first machining cycle is realized on a first base circle and a further machining cycle is realized on a base circle which is different from the first base circle.

Further, it is a special advantage that a separate transport of the fine blanked and formed parts within the tool by means of a cross slide is no longer required. Besides its active function, the cutting die also takes over the transport function. The workpieces are completely cut out and separated from the pressed screen, so that material wasting re-cuts do not have to be accepted any more, especially in connection with small parts. This leads to significant savings of material in the case of small and medium sized fine blanking parts, whereby the application of fine blanking stays lucrative despite of significantly rising steel prices.

Because the fine blanked and formed workpieces after cutting or forming operation are received and clamped in the process openings and transported to the next machining stage, the workpieces are advantageously no longer damaged during the fine blanking or forming process by slugs possibly left in the tool area.

Due to the transfer of the workpieces by means of the cutting die and the elimination of a separate slide for transporting the parts, the ram stroke of the press as a whole can be significantly reduced, which makes it possible to significantly increase the quantity of strokes, i.e., the quantity of cycles.

Further advantages, characteristics and details will be apparent from the following description with reference to the attached drawings.

In the following the invention will be explained in more detail at the example of an embodiment.

DETAILED DESCRIPTION OF THE INVENTION

Figure 1:
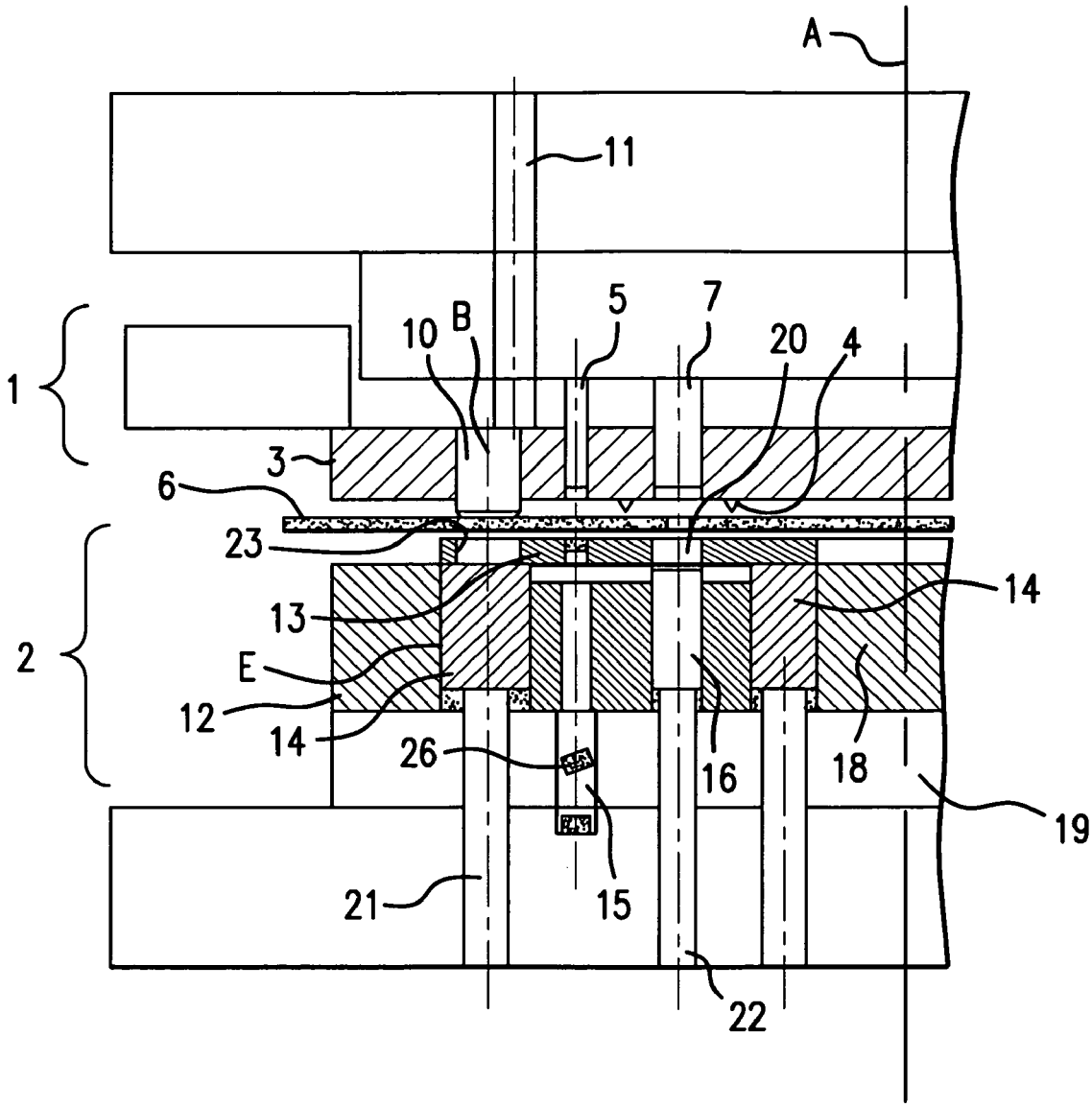
FIG. 1 a cross-section through the device according to the invention in the open state of upper and lower parts along line A-A of FIG. 2.

FIG. 1 shows the principle structure of a device according to the invention for producing a fine blanked and formed workpiece W.

The device according to the invention has an upper part 1 and a lower part 2. The upper part 1 of the device comprises a pressure pad 3 with a V-shaped projection 4, a punch 5 for punching a flat strip 6, a shearing punch 7 for cutting out a punched blank 8 from the flat strip 6, a coining die 9 (see FIG. 4) for carrying out a coining operation at the cut out blank 8 and at least two locking bolts 10. The active elements, including punch 5, shearing punch 7 and coining punch 9 are guided in the pressure pad 3. Their respective working direction is perpendicular to the flat strip 6. The two locking bolts 10 are arranged near the outer edge of the pressure pad 3 and are diametrically opposed to each other.

The upper stud 11, under hydraulic pressure, presses on the pressure pad 3.

The lower part 2 comprises a mounting 12, a disk-shaped cutting die 13 with guiding element 14, a waste channel 15, an ejector 16, a coining anvil 17 and a central journal 18 fixed on the lower pressure plate 19. Cutting die 13 and guiding element 14 form a common construction element which is turnable. Respective cutting openings 20 which are allocated the active elements 5, 7 and 9, respectively, and provided in the cutting die 13.

The cutting die 13, with its guiding element 14, is supported in the center of the journal 18.

The guiding element 14, with its outer circumference, supports on the mounting 12, in a plane E between the guiding surfaces of mounting 12 and guiding element 14, a driving element (not shown), for example, a stepping motor, for creating the necessary drive moment for rotating the cutting die 13 around its virtual axis A on the axis of the journal 18.

A stud 21, under hydraulic pressure, acts on the guiding element 14, with the help of which, the cutting die 13, together with its guiding element 14, can carry out a determined stroke movement perpendicular to the flat strip 6. The ejector 16 as support of the shearing punch 7 is supported by a further stud 22 under hydraulic pressure.

Several locking openings 23 are arranged near the outer circumference of the disk-shaped cutting die 13, lying diametrically opposite to each other. In closed lining up of upper and lower parts 1 and 2, the two locking bolts 10 lying diametrically opposite to each other, respectively engage two locking openings 23. The central axis of a respective one of the locking openings 23 lies on the axis line B of locking bolt 10. The locking openings 23 in this case are distributed along the circumference of the cutting die 13 in such a way that in case of the engagement of the locking bolts 10, the respective effective elements of upper and lower parts 1 and 2 together can form a pair of effective elements, i.e., one machining stage, respectively. The flat strip 6 in the closed state of upper and lower parts is clamped between pressure pad 3 and cutting die 13, and the V-shaped projection 4 has already penetrated the flat strip 6.

The punch 5 and the respective cutting opening 20 of the cutting die 13, shearing punch 7 in the upper part 1 and ejector 16 in the lower part 2, as well as coining stamp 9 in the upper part 1 and coining anvil 18 in the lower part 2, form respective pairs of effective elements lying on a common base circle GK, as is in the following described in detail in FIG. 2, the center of which is the virtual axis A.

Figure 2:
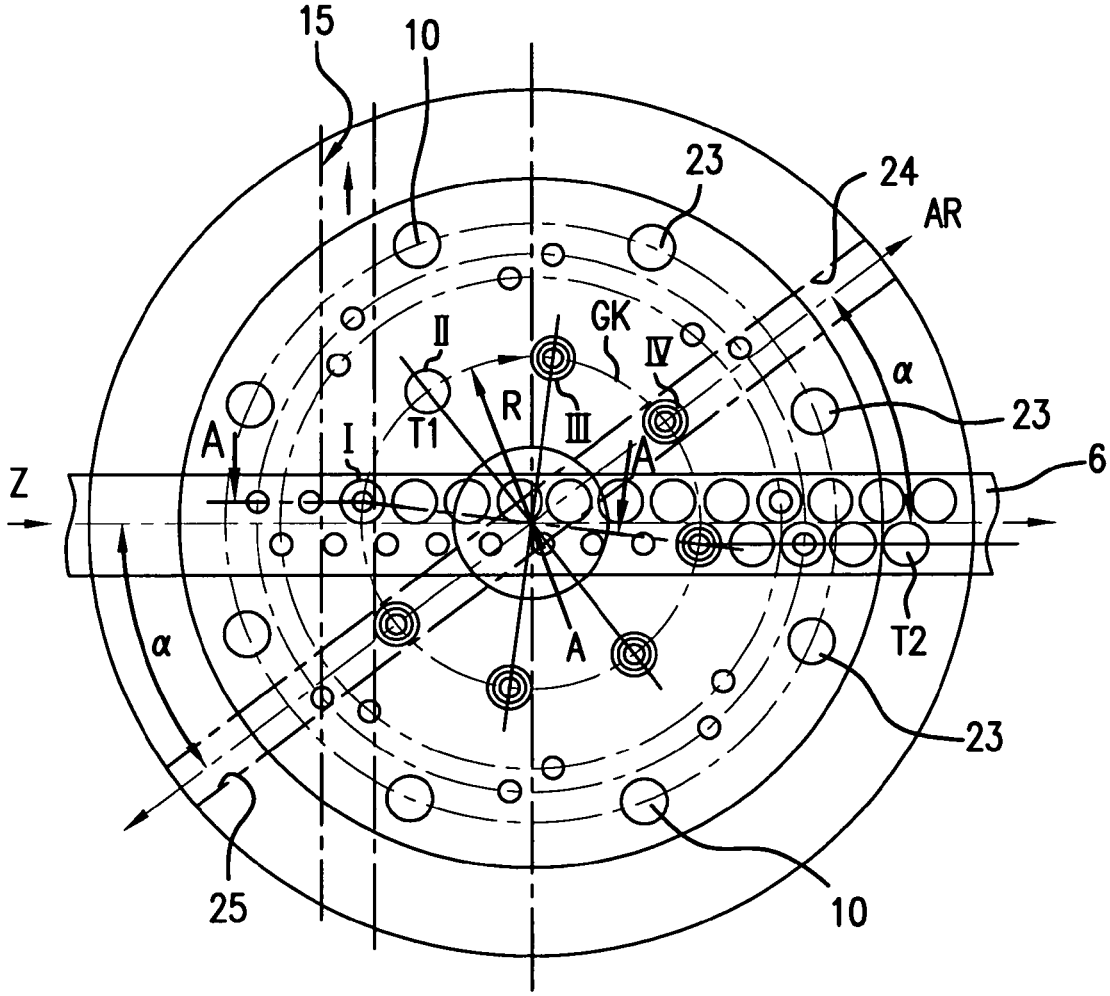
FIG. 2 is a top view of the device according to this invention as shown in FIG. 1.

FIG. 2 shows a top view of the device according to this invention illustrating the operational process of the method according to this invention.

In the first processing step I, the blank 8, possibly also an inner form, is cut out from the row of parts T1 of the flat strip 6 into the process opening 20 of cutting die 13 and not ejected. Blank 8 stays in the process opening 20. During the opening of upper part 1 and lower part 2 of the device according to this invention, the cutting die 13 together with guiding element 14 is lifted by the hydraulically operated studs 21 and with the blank 8 in the cutting opening 20 turned into the next following process position. In the example shown here the rotational movement is carried out clockwise to the rear side of the device. Of course it is also part of this invention when the rotation direction is counter-clockwise.

In the second processing step II, upper and lower parts 1 respectively 2 are closed, whereby the locking bolts 10 engage the respective locking openings 23 of cutting die 13. The cutting die 13 now is fixed by the locking bolts 10 and the blank 8 can undergo the next following processing operation, for example coining or ejecting the slugs 26 into a channel 15 (see FIG. 1).

In the third processing step III, the cutting die 13 again with the staying in the process opening 20 blank 8 during opening of upper and lower parts is lifted and turned until the next following process position (processing stage) is reached. The cutting die 13, is, as described already in the second processing step, fixed and upper and lower parts are closed. The respective process operation is carried out, wherein the process steps are repeated until machining of the part is finished.

In the fourth processing step IV, the finished workpiece is ejected from the cutting opening 20 of cutting die 13 into a channel 25 and removed from the inner space of upper and lower parts for example by blowing it out. After opening upper and lower parts 1 respectively 2, lifting and turning of cutting die 13 the now free cutting opening 20 in the cutting die 13 reaches the process position in the row of parts T2 of flat strip 6, so that a new machining cycle can be carried out clockwise on the front side of the device.

The feeding direction Z of the flat strip 6 into the device according to this invention exceeds over the center, i.e., along the virtual axis A, so that it is readily possible to apply flat strips 6 with different widths, when the base circle GK is respectively adjusted to the arrangement of the single machining stages.

According to the number of necessary machining cycles the single pairs of effective elements can lie on concentrically to each other arranged base circles GK, which respectively have different from the virtual rotation axis A of cutting die 13 radii R, so that several processing operations can be carried out simultaneously.

Each machining cycle is allocated a channel 25 for transporting the finished workpieces outside. The outlet direction AR of the finished parts can vary according to the quantity of pairs of effective elements (machining stages). Thus, the angles $\alpha$ with regard to the feeding direction of the flat strip 6 may vary.

The channel 24 for removing of the slugs exceeds perpendicular to the feeding directions of the flat strip 6 and thus is completely separated from the removal of the finished parts, so that respective malfunctions caused by left in the tool area slug rests are excluded.

Figure 3:
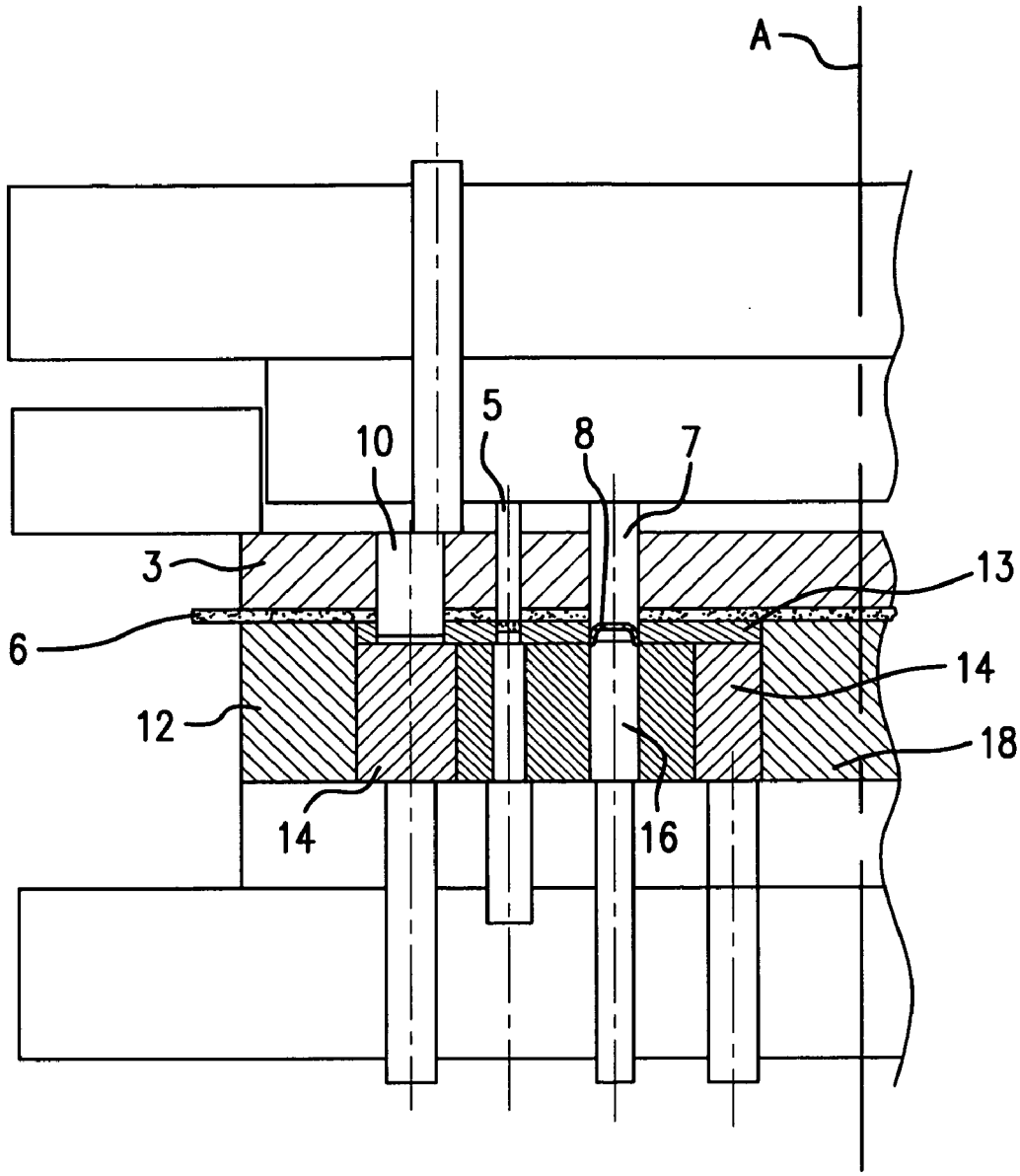
FIG. 3 is a section through the device according to the invention in the machining stage "cutting" in the upper dead center according to the method of this invention.
Figure 4:
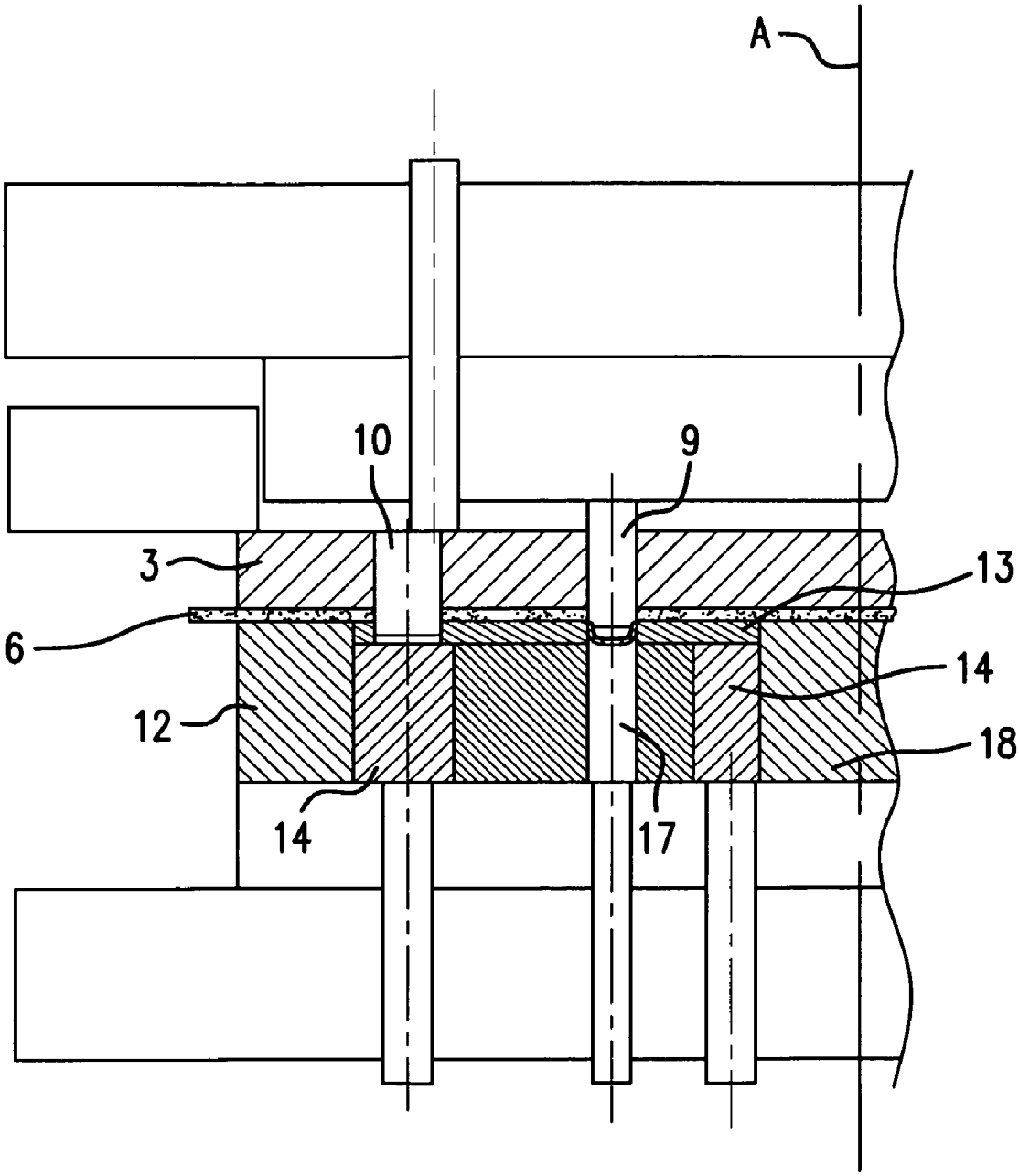
FIG. 4 is a section through the device according to the invention in the machining stage "coining" in the upper dead center according to the method of this invention.
Figure 5:
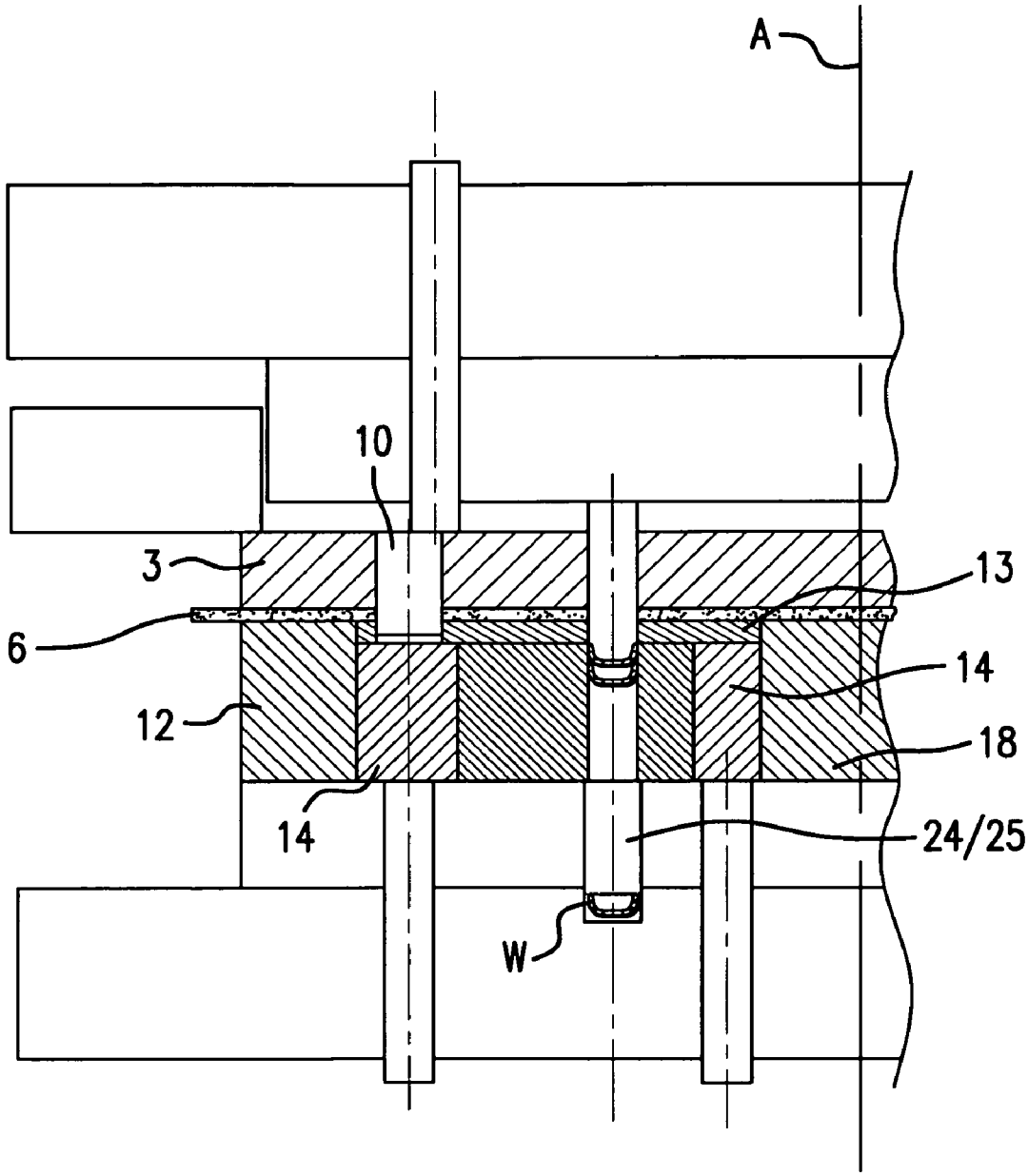
FIG. 5 is a section through the device according to the invention in the machining step "ejecting" in the upper dead center according to the method of this invention.

FIGS. 3 to 5 illustrate the processing steps cutting, coining and ejecting. In FIG. 3, upper part 1 and lower part 2 are closed and the flat strip 6 is clamped between pressure pad 3 and mounting 12. The locking bolt 10 is engaged in locking opening 23. The cutting die 13 is fixed. The punch 5 and the shearing punch 7 have cut respective parts into to the process opening 20 of the cutting die 13.

FIG. 4 shows the processing operation coining. Upper part 1 and lower part 2 of the device according to this invention are closed and the cutting die 13 is fixed by the locking bolt 10. The coining stamp 9 and the coining anvil 17 are in working position.

In FIG. 5 the ejection of finished fine blanked and formed workpieces is depicted. A finished part is ejected into channel 25 and, for example, can be blown outside.

The invention claimed is:

1. A device for fine blanking and forming a workpiece from a flat strip through several machining steps, the device comprising:

an upper part, including punches and/or a forming element and an upper pressure plate for the punches and/or the forming element that defines V-shaped projections thereon, each of the punches and/or forming element and upper pressure plate serving as effective elements of the upper part;

a lower part, including effective elements comprising a cutting die, an ejector, a forming anvil and a lower pressure plate;

the flat strip being clamped between said upper pressure plate defining V-shaped projections carried thereon and said lower part when closed, and movable in a feeding direction in an open state of said upper and lower parts in one machining cycle including blanking, fine blanking, preforming and/or punching;

the cutting die being formed as a disc-shaped transfer part with several cutting openings respectively paired with one or more of the effective elements, which takes up and clamps a cut out blank, to transport the cut out blank from one machining stage to a next machining stage, the transfer part being turnable with regard to the effective elements of the upper part around a virtual axis in a center of the transfer part and parallel to a machining direction, turnable perpendicular to the virtual axis after being lifted over the effective elements of the lower part comprising a respective cutting opening of the cutting die, the ejector and the forming anvil, and the cutting openings in the transfer part being arranged on a common base circle, a radius of said common base circle coinciding with a distance of the machining stage to the virtual axis; and machining stages of the upper part being arranged on the common base circle at fixed distances to each other, and machining stages in the transfer part being allocated at least two locking bolts diametrically opposed at the circumference, fixed in the pressure pad of the upper part, the locking bolts being arranged parallel to the virtual axis and several of said locking bolts being arranged diametrically opposed at respective circumference locking openings in the transfer part for adjusting, fixing and lining up the effective elements of the upper and lower parts to each other.

2. A device according to claim 1, wherein:

the transfer part includes a guiding element held in a mounting arranged on the lower pressure plate for vertically moving the transfer part in the direction of an axis of the locking bolts against the upper pressure plate; and a journal fixed at a stud, wherein the transfer part is turnable around the journal.

3. A device according to claim 2, wherein the cutting die and the guiding element form a common construction unit.

4. A device according to claim 2, wherein that the guiding element is allocated a stepping motor engaging in a plane between the mounting and the guiding element at an outer circumference of the guiding element to turn the transfer part from machining stage to machining stage.

5. A device according to claim 1, wherein the axis of a respective locking bolt and a respective locking opening in a closed state of upper and lower parts are arranged on one common line.

6. A device according to claim 1, wherein all machining stages of one machining cycle are arranged on the base circle.

7. A device according to claim 1, wherein the machining stages of several machining cycles are arranged on base circles lying concentrically to each other, and which are disposed respectively different distances from the virtual axis of the transfer part.

8. A device according to claim 1, wherein a feeding and outlet direction of the flat strip exceeds over the center of the base circle.

9. A device according to claim 8, further comprising at least one outlet channel for finished workpieces, a direction of said at least one outlet channel being variable with regard to the outlet direction of the flat strip.

10. A device according to claim 1, further comprising at least one outlet channel for finished workpieces, a direction of said at least one outlet channel being variable with regard to the feeding direction of the flat strip.

11. A device according to claim 1, wherein at least one outlet channel is provided for slugs.

12. A method for fine blanking and forming a workpiece from a flat strip, wherein the flat strip is subjected to several effective elements of an upper part including a shearing punch, a forming element, an upper pressure plate defining a series of V-shaped projections, and several effective elements of a lower part including a cutting die including a plurality of cutting openings, an ejector, a anvil and/or a lower pressure plate, the method comprising throughout one or more machining stages of a machining cycle:

clamping the flat strip between said upper pressure plate defining said V-shaped projections thereon and said lower part by closing the upper and lower parts during machining thereof;

moving the flat strip on, step by step, in a feeding direction in an open state of said upper and lower parts;

receiving and clamping or storing a cut out workpiece and/or blank in a cutting opening of the cutting die and lifting the cutting die with the workpiece remaining in the cutting opening over the effective elements of the lower part; and rotatably moving the cutting die, by an amount which coincides with a distance of respective ones of the upper and lower part effective elements from each other, step by step, so that the workpiece is fed to the effective elements of the upper part, wherein during every turning step, the effective elements of the upper part and the effective elements of the lower part are registered with and closed with respect to each other so as to form a pair of effective elements of a respective one of the machining stages.

13. A method according to claim 12, wherein movement of the cutting openings in the cutting die and movement of the effective elements of the upper part are carried out on a common base circle.

14. A method according to claim 12, sequentially comprising:

cutting out the blank into a process opening of the cutting die, said blank remaining in the process opening with upper and lower parts closed following lift of the cutting die over the effective elements of the lower part and stepwise turning of a respective one of the process opening of the cutting die to a next following machining stage with upper and lower parts open;

lining up and fixing of the effective elements during closing of the upper and lower parts and carrying out a next forming operation;

carrying out said cutting and lining up again, wherein said cutting and lining up are repeated until machining of the part is finished; and ejecting and blowing out a finished part with the upper and lower parts open, wherein the cutting die, after the lift movement, is turned until the process opening of a free machining stage is reached for carrying out a new machining cycle.

15. A method according to claim 14, wherein a first machining cycle is carried out on a first base circle and a further machining cycle is carried out on a further base circle, a radius of which is different from that of the first base circle so that several machining cycles are performable simultaneously.

16. A method according to claim 15, wherein the flat strip is led over the center of the first base circle.

17. A method according to claim 14, wherein the finished part is removed from the opened upper and lower parts by blowing out or band transport.

18. A method according to claim 14, wherein slugs are removed from the closed upper and lower parts by blowing out or band transport.

* * * * *